US008511886B2

(12) United States Patent
Vasshus et al.

(10) Patent No.: US 8,511,886 B2
(45) Date of Patent: Aug. 20, 2013

(54) MIXING APPARATUS AND METHOD OF USING SAME

(75) Inventors: Jan Kristians Vasshus, Sandnes (NO); Trond Melhus, Sandnes (NO)

(73) Assignee: Cubility AS, Sandnes (NO)

( * ) Notice: Subject to any disclaimer, the term of this patent is extended or adjusted under 35 U.S.C. 154(b) by 0 days.

(21) Appl. No.: 12/996,583

(22) PCT Filed: Jun. 12, 2009

(86) PCT No.: PCT/NO2009/000219

§ 371 (c)(1),
(2), (4) Date: Feb. 10, 2011

(87) PCT Pub. No.: WO2009/154468

PCT Pub. Date: Dec. 23, 2009

(65) Prior Publication Data

US 2011/0299357 A1 Dec. 8, 2011

(30) Foreign Application Priority Data

Jun. 20, 2008 (NO) ..... 20082795

(51) Int. Cl.
*B01F 15/02* (2006.01)

(52) U.S. Cl.
USPC ..... 366/132; 366/163.1; 366/182.3; 366/136; 366/142

(58) Field of Classification Search
USPC ..... 366/163.2, 182.3, 182.4, 136, 137, 366/163.1, 132, 142
See application file for complete search history.

(56) References Cited

U.S. PATENT DOCUMENTS

| | | | | | |
|---|---|---|---|---|---|
| 3,565,404 | A * | 2/1971 | Reid et al. | 366/137 |
| 3,608,869 | A * | 9/1971 | Woodle | 366/132 |
| 3,831,906 | A * | 8/1974 | Wakeman | 366/172.2 |
| 3,893,655 | A | 7/1975 | Sandiford | |
| 4,342,036 | A | 7/1982 | Scott et al. | |
| 4,433,701 | A * | 2/1984 | Cox et al. | 137/101.19 |
| 4,747,272 | A * | 5/1988 | Howell et al. | 62/136 |
| 4,863,277 | A * | 9/1989 | Neal et al. | 366/137 |
| 5,344,619 | A * | 9/1994 | Larwick et al. | 422/261 |
| 5,624,182 | A | 4/1997 | Dearing, Sr. et al. | |
| 5,785,423 | A * | 7/1998 | Chikami | 366/165.3 |
| 6,824,369 | B2 * | 11/2004 | Raymond | 418/184 |
| 2001/0011688 | A1 | 8/2001 | Whitlatch et al. | |
| 2002/0125046 | A1 | 9/2002 | Schauerte | |
| 2004/0249105 | A1 * | 12/2004 | Nolte et al. | 528/44 |
| 2005/0219945 | A1 * | 10/2005 | Kelley et al. | 366/142 |

FOREIGN PATENT DOCUMENTS

| | | | |
|---|---|---|---|
| DE | 4217373 | A1 | 12/1993 |
| WO | WO 2008/024847 | A1 | 2/2008 |

* cited by examiner

*Primary Examiner* — Tony G Soohoo
(74) *Attorney, Agent, or Firm* — Gablegotwals

(57) ABSTRACT

An apparatus (1) and a method for ad-mixing an additive for a drilling fluid for use in the drilling of a petroleum well are described. The apparatus (1) includes: a mixing chamber (3) which is connected, in terms of fluid, to an inlet line (5) for drilling fluid, an outlet line (7) for drilling fluid and at least one dosing device (9, 9') for an additive, the dosing device (9, 9') being arranged to supply the additive from a container (11, 11') to the mixing chamber (3) and to form a pressure-tight barrier between the mixing chamber (3) and the container (11, 11'); and a pumping device (13) arranged downstream of the mixing chamber (3), which is arranged to suck drilling fluid through the mixing chamber (3).

8 Claims, 1 Drawing Sheet

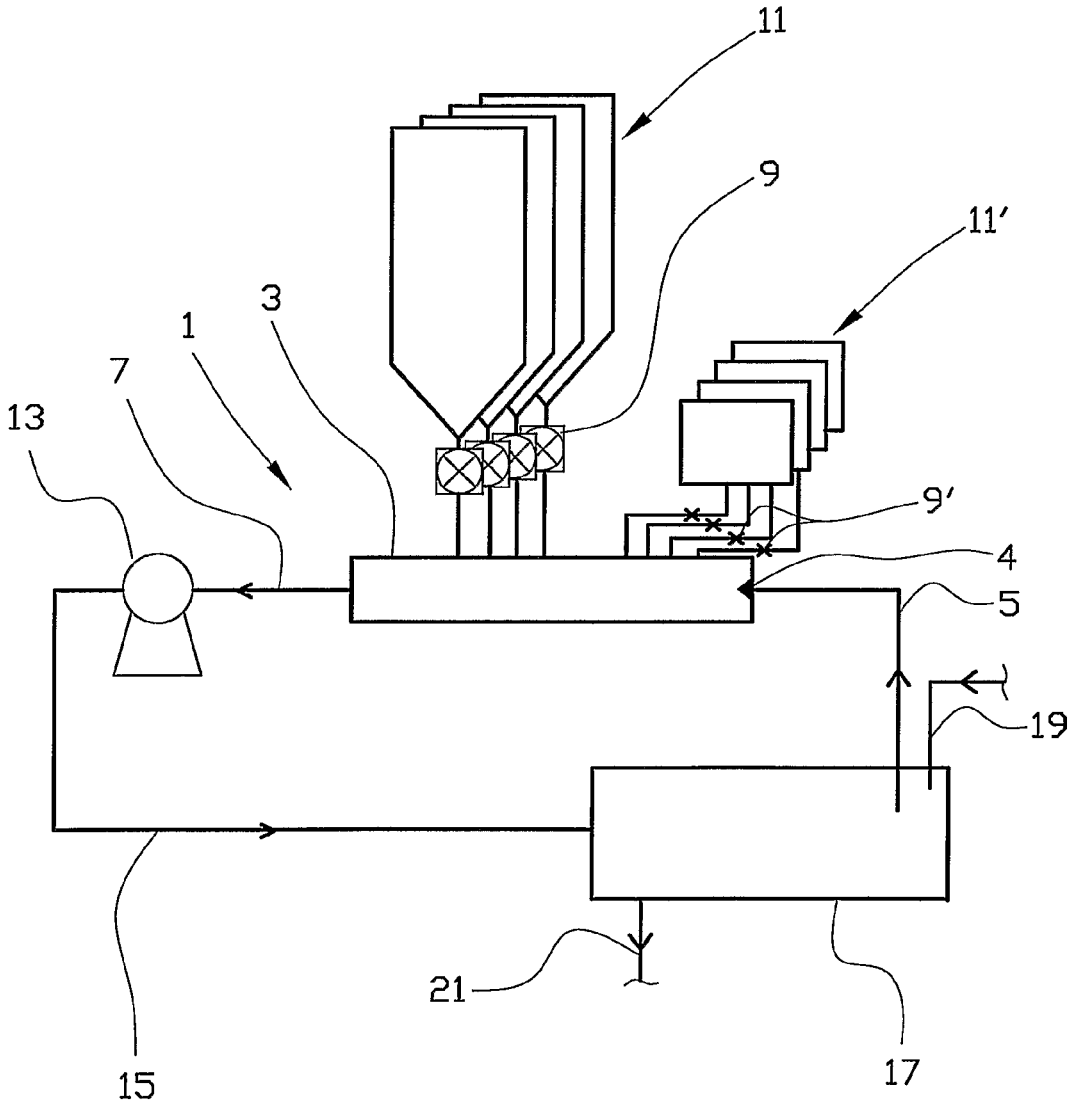
11
9
11′
3
1
7
13
9′
4
5
19
21
15
17

MIXING APPARATUS AND METHOD OF USING SAME

The present invention relates to a mixing apparatus and a method of using same. More particularly, the invention relates to an apparatus and a method for admixing an additive for a drilling fluid for use in the drilling of a petroleum well.

By the term drilling fluid is meant, in this document, a fluid used to lubricate and cool a drill bit, to circulate drilled material out of the well, and to achieve well control.

A person skilled in the art will know that additives for drilling fluids could be both in liquid form and in the form of dry solids.

Drilling fluids used in connection with the drilling of a petroleum well must be optimized for various parameters such as, but not limited to, specific weight and viscosity. It is usual for a drilling fluid, which is circulated out of a well together with cuttings, to be circulated back into the well for reuse after having been cleaned of particulate material over a certain size. However, it is desirable that the drilling fluid is analysed and its composition possibly adjusted for it to achieve optimal properties.

To be able to mix additives into a drilling fluid, it is known to use a centrifugal pump which establishes a flow of drilling fluid into a so-called mixing apparatus, or just "mixer". The mixer includes a nozzle in the form a venturi tube. When drilling fluid is forced at high velocity into the mixer by means of the centrifugal pump, an underpressure is created in the mixer. This underpressure has the effect of enabling additives to be sucked from one or more storage containers into the mixing chamber in which they are mixed with the drilling fluid. Thus, the admixture of additives is based on the so-called "venturi principle" which will be well known to a person skilled in the art.

However, the admixture of additives with a drilling fluid by the use of a centrifugal pump to establish said venturi principle is encumbered with some considerable drawbacks.

For a sufficient venturi effect to be achieved, the drilling fluid must be pumped into the mixer at a certain pressure and at a certain flow rate which are determined by the design of the venturi tube and not by the need of drilling fluid existing at any time.

A centrifugal pump will require the existence of a positive pressure on the suction side and such arrangement of the mixer that the drilling fluid downstream of the mixer will flow, by means of gravitational forces, to a storage container, for example. This means that the storage container must be placed at a lower level than the mixer and that a supply container for drilling fluid to the centrifugal pump must be placed at a higher level than the centrifugal pump. Such physical requirements for the positioning of the equipment will very often result in a non-optimal positioning, seen in relation to a positioning determined on the basis of considerations of centre of gravity and a desire to occupy as little space as possible on board a drilling rig, for example.

Experience goes to show that, in the pipes downstream of the mixer, the flow of drilling fluid occasionally becomes s plugged by the drilling fluid. Such plugging may be due to the pipe clogging up and/or the centrifugal pump supplying more drilling fluid than the pipes can carry away. Such plugging has resulted in drilling fluid having flowed out of the mixer through its suction pipe and caused serious damage to both humans and the environment.

Thus, a prior-art mixer involves a considerable health and safety risk.

The invention has for its object to remedy or to reduce at least one of the drawbacks of the prior art.

The object is achieved through features which are specified in the description below and in the claims that follow.

In a first aspect of the present invention there is provided an apparatus for admixing an additive for a drilling fluid for use in the drilling of a petroleum well, the apparatus including:

- a mixing chamber to which there are connected, in terms of fluid, an inlet line for drilling fluid, an outlet line for drilling fluid and at least one dosing device for an additive, the dosing device being arranged to supply the additive from a container to the mixing chamber and to form a pressure-tight barrier between the mixing chamber and the container; and
- a pumping device arranged downstream of the mixing chamber, which is arranged to suck drilling fluid through the mixing chamber.

The mixing chamber with the inlet and outlet lines for drilling fluid and a fluid communication line to each of the at least one dosing device are tight towards the surroundings. This results in the pumping device creating an upstream underpressure. The additive is therefore sucked in from the at least one dosing device into the mixing chamber.

It is an advantage if an upstream portion of the mixing chamber is provided with a restriction. The restriction is preferably adjustable, so that the desired underpressure in the mixing chamber can be achieved. The restriction may even be positioned in the drilling-fluid inlet line itself, near the mixing chamber.

Preferably, the dosing device is of a so-called volumetric type.

It is an advantage if the pumping device is a so-called volumetric pump. A volumetric pump provides a relatively accurate stream or "flow" at a given rotational speed of the pumping device. To be able to control the flow of drilling fluid through the mixing chamber, it is an advantage if the pumping device is frequency-controlled.

A type of volumetric pump, which has proved suitable through trials, is a so-called lobe pump.

It is an advantage if, downstream of the mixing chamber, there is arranged a device for sampling and analysis of the drilling fluid, so that a result may be compared with a predefined or desired result. Preferably, all or parts of the sampling, analysing and evaluating work is/are automated, in a manner known per se, by means of software and a computer.

It is an advantage if the feeding of additive(s) is controlled automatically on the basis of information from said evaluation and information on the flow through the apparatus.

In a second aspect of the invention there is provided a method of admixing an additive for a drilling fluid for use in the drilling of a petroleum well, the method including sucking drilling fluid through a mixing chamber and supplying the additive from at least one container by means of a dosing device connected to the container, the dosing device forming a pressure-tight barrier between the container and the mixing chamber.

In what follows is described an example of a preferred embodiment which is visualized in the accompanying drawing in which:

FIG. 1 shows a principle drawing of an apparatus for the admixture of additives according to the present invention.

It will be understood that the sketch is not to scale and that the relative size proportions of the individual components have not been depicted in the correct relative proportions either.

In the figure the reference numeral 1 indicates an apparatus in accordance with the present invention. The apparatus 1 includes a mixing chamber 3 to which there are connected, in terms of fluid, an inlet line 5 for drilling fluid, an outlet line 7 for drilling fluid and eight dosing devices 9, 9'. The dosing devices 9, 9' are connected, in terms of fluid, to respective containers 11, 11' of additives.

The containers indicated by the reference numeral 11 in the figure may be, for example, containers for storing solids, so-called bulk material, whereas the containers indicated by the reference numeral 11' in the figure may be, for example, containers for storing additives in liquid form.

The dosing devices 9, 9' are arranged to form, in a manner known per se, a pressure-tight barrier between the mixing chamber 3 and the containers 11, 11'.

The dosing devices 9 communicating with the containers 11 may be, for example, volumetric dosing valves of a kind known per se, which is suitable for dosing, into the mixing chamber 3, a desired volume of additive in solid form from the container 11.

The dosing devices 9' which communicate with the containers 11' may be, for example, needle valves of a kind known per se which is suitable for dosing, into the mixing chamber 3, a desired volume of additive in liquid form from the container 11'.

Downstream of the mixing chamber 3 is arranged a pumping device 13 which is arranged to suck drilling fluid through the mixing chamber 3. A person skilled in the art will understand that to achieve a best possible suction effect, the part of the apparatus 1 located upstream of the pumping device 13 must be fluid-tight towards the surroundings.

In an upstream inlet portion, the mixing chamber 3 is provided with a restriction 4. The restriction 4 may be fixed or adjustable. By fitting an adjustable restriction 4, the underpressure in the mixing chamber 3 can be adjusted to the needs existing at any time.

In the embodiment shown, the apparatus 1 is arranged in a pipe loop including a return line 15 connected to an intermediate storage container 17. In the trade, such an intermediate storage container 17 for drilling fluid is often called a "mixing tank".

The intermediate storage container or mixing tank 17 is provided with a supply line 19 for drilling fluid and a drain line 21 for drilling fluid.

It will be understood that the supply line 19 and drain line 21 are each provided with a valve (not shown) to be able to shut off fluid communication with the mixing tank 17.

Drilling fluid which has been circulated out of the well and cleaned of cuttings, possibly new drilling fluid, is supplied to the mixing tank 17 through the supply line 19. This supplied drilling fluid may be considered as "untreated".

Designing or adjusting the characteristics of the drilling fluid will typically include the following steps:

- A desired amount of untreated drilling fluid is carried into the mixing tank 17 through the supply line 19;
- The need of additive(s) is determined from measured or known properties of the drilling fluid supplied and from desired properties. Samples may be taken, for example, from drilling fluid which is in the mixing tank 17 or from any point along the lines 5, 7, 15;
- The pumping device 13 sucks drilling fluid from the mixing tank 17 and through the mixing chamber 3 while, at the same time, relevant dosing devices 9, 9' are operated into delivering doses of additives;
- Drilling fluid with additive(s) added is carried downstream of the pumping device 13 through the return line 15 and back into the mixing tank 17. Samples are taken at set intervals from one or more points mentioned above;
- When the desired amount of drilling fluid has achieved the desired properties, the drilling fluid may be carried out through the drain line 21 and circulated back into the well.

It will be understood that in some cases it may be necessary to circulate the drilling fluid which is in the mixing tank 17 several times through the apparatus 1 to achieve the desired properties for the drilling fluid.

The apparatus 1 according to the present invention is very well suited for automation. A person skilled in the art will know that there is equipment available which. is arranged to analyse the drilling fluid practically continuously while it is flowing in the lines 5, 7, 15 or while it is in the mixing tank 17, for example. The results of such an analysis may be fed to a computer (not shown) which compares measured results with data entered in advance. Whenever there is a difference between them, the computer may calculate the need for supplying one or more additives. Signals may be output to a control system (not shown) for the dosing devices 9, 9', the dosing is being adjusted to the flow of drilling fluid through the mixing chamber 3. The flow of drilling fluid can be measured or calculated when the rotational speed of the volumetric pumping device 13 is known.

It is an advantage if the mixing tank 17 is a closed container. It is also an advantage if the containers 11, 11', in which the additives are kept, are closed. Since, in terms of fluid, the apparatus 1 is closed towards the surroundings, the entire process of designing or adjusting the drilling fluid will thereby run in a closed system. This has considerable advantages with respect to a safe working environment.

If a blocking or plugging of the fluid flow in the return line 15 downstream of the pumping device 13 should occur, the flow of fluid through the mixing chamber 3 will stop and the underpressure be reduced towards zero. However, overpressure cannot form in the mixing chamber 3 even if the pumping device 13 should continue pumping. The problem of drilling fluid flooding out through the apparatus 1 is thereby eliminated.

In FIG. 1 the apparatus 1 is shown as being connected to the mixing tank 17. However, the drilling fluid could be adjusted to desired properties or needs also without the use of the mixing tank 17 shown. For example, the inlet line 5 for drilling fluid may be connected to a source (not shown) of "untreated" drilling fluid, and the return line 15 downstream of the pumping device could be connected to an upstream side of a drilling-fluid circulation system (not shown).

Said source of untreated drilling fluid would typically be connected to cleaning devices arranged to separate cuttings, which are being brought up from the borehole, from the drilling fluid. In one embodiment the inlet line 5 is connected to a so-called "degasser".

When the apparatus 1 is arranged without the use of the mixing tank 17, the analysis of the drilling fluid must be done upstream of the mixing chamber 3. An automatic analysing and dosing system as described earlier will be advantageous in this connection.

A person skilled in the art will understand that the apparatus and method according to the present invention exhibit highly advantageous features seen in relation to known apparatuses and methods used when admixing an additive for a drilling fluid. The advantages relate both to possibilities of controlling the flow rate through the mixing chamber by controlling the pumping devices 13 and to almost eliminating the risk of overflow or so-called "flooding" of drilling fluid out of the apparatus 1, which could harm personnel and environment. In addition, the apparatus 1 according to the invention and connected fluid containers 17, if any, are optimally positioned, based on the wish for a minimal need for space and/or considerations of centre of gravity and not on requirements as to relative elevations of the pump and containers.

The invention claimed is:

1. An apparatus (1) for mixing an additive for drilling fluid used in drilling a petroleum well, said apparatus (1) comprising:

a mixing tank (17), to which there is connected an inlet line (19) arranged to supply a drilling fluid which has been circulated out of the petroleum well to the mixing tank (17);

a mixing chamber (3), to which there is connected an inlet line (5) arranged to receive the drilling fluid from the mixing tank (17) and an outlet line (7) arranged to return the drilling fluid to the mixing tank (17);

at least one dosing device (9, 9') for an additive, the dosing device (9, 9') being a valve arranged for switching between a supplying position in which the additive is supplied from at least one container (11, 11') to the mixing chamber (3) and a non-supplying position in which the valve forms a pressure-tight barrier between the mixing chamber (3) and the at least one container (11, 11');

means for regulating a flow of the drilling fluid into the mixing chamber (3), the regulating means being arranged at the inlet or upstream of the mixing chamber (3); and a volumetric pumping device (13), the volumetric pumping device (13) being arranged to create an underpressure in the mixing chamber (3) sufficient to suck the drilling fluid from the mixing tank (17) and also the additive from the at least one container (11, 11') into and through the mixing chamber (3) when the at least one dosing device (9, 9') is in the supplying position.

2. The apparatus in accordance with claim 1, wherein the pumping device (13) is frequency-controlled.

3. The apparatus in accordance with claim 1, wherein the apparatus (1) is provided with a device for automatically sampling, analyzing and evaluating the drilling fluid while flowing in lines (5, 7, 15) or in a mixing tank (17).

4. The apparatus in accordance with claim 3, wherein the device for automatically at least sampling and analyzing the drilling fluid is arranged downstream of the mixing chamber (3).

5. The apparatus in accordance with claim 3, wherein the device for automatically at least sampling and analyzing the drilling fluid is arranged upstream of the mixing chamber (3).

6. The apparatus in accordance with claim 3, wherein the feeding of additive(s) by the dosing device is automatically controlled on basis of information from the sampling, analyzing and evaluating of the drilling fluid while flowing in lines (5, 7, 15) or in the mixing tank (17) and from information on flow through the pumping device (13).

7. A method for mixing an additive for drilling fluid used in drilling a petroleum well, said method comprising the steps of:

supplying a mixing tank (17) with a drilling fluid which has been circulated out of the petroleum well, wherein the mixing tank (17) is arranged to send the drilling fluid to a mixing chamber (3) and receive a mixed drilling fluid from the mixing chamber (3);

providing an underpressure in the mixing chamber (3) by means of a volumetric pumping device (13) arranged downstream of the mixing chamber (3) and means for regulating a flow of fluid from an inlet line (5) into the mixing chamber (3), the regulating means being arranged upstream of the mixing chamber (3);

sucking the drilling fluid from a mixing tank (17) through the mixing chamber (3) by means of the volumetric pumping device (13); and controlling the supply of an additive from at least one container (11, 11') by means of a dosing device (9, 9') which is arranged to be operated between a non-supplying position, in which the dosing device (9, 9') forms a pressure-tight barrier between the container (11, 11') and the mixing chamber (3), and a supplying position, in which the additive is sucked from the container (11, 11') via the dosing device (9, 9') into the mixing chamber (3).

8. The method in accordance with claim 7, wherein mixing of additive(s) is controlled automatically on basis of information selected from at least one member of the group consisting of: measurements and analysis of the drilling fluid upstream of the mixing chamber (3); measurements and analysis of the drilling fluid downstream of the mixing chamber (3); and information on flow through the apparatus (1).

* * * * *